US010081038B2

(12) United States Patent
Steinmann

(10) Patent No.: US 10,081,038 B2
(45) Date of Patent: Sep. 25, 2018

(54) AIR CONDITIONER CONDENSER COIL CLEANING: METHOD, COMBINATION, APPARATUS

(71) Applicant: Jacob F. Steinmann, Ridgefield, CT (US)

(72) Inventor: Jacob F. Steinmann, Ridgefield, CT (US)

(73) Assignee: Coil Pod LLC, Yorktown Heights, NY (US)

( * ) Notice: Subject to any disclaimer, the term of this patent is extended or adjusted under 35 U.S.C. 154(b) by 261 days.

(21) Appl. No.: 13/573,539

(22) Filed: Sep. 21, 2012

(65) Prior Publication Data

US 2013/0160800 A1 Jun. 27, 2013

Related U.S. Application Data

(60) Provisional application No. 61/626,404, filed on Sep. 26, 2011.

(51) Int. Cl.

| | |
|---|---|
| ***B08B 5/02*** | (2006.01) |
| ***B08B 15/02*** | (2006.01) |
| ***F24F 13/20*** | (2006.01) |
| ***F24F 1/58*** | (2011.01) |
| *F25B 47/00* | (2006.01) |
| *F25B 39/02* | (2006.01) |

(52) U.S. Cl.

CPC ..... *B08B 5/02* (2013.01); *B08B 15/02* (2013.01); *F24F 1/58* (2013.01); *F24F 13/20* (2013.01); *F25B 39/02* (2013.01); *F25B 47/00* (2013.01)

(58) Field of Classification Search

None

See application file for complete search history.

(56) References Cited

U.S. PATENT DOCUMENTS

| | | | |
|---|---|---|---|
| 3,510,905 | A | 5/1970 | Bannert |
| 3,964,123 | A | 6/1976 | Pettersson |
| 3,978,547 | A | 9/1976 | Lawson |

(Continued)

OTHER PUBLICATIONS

"Refrigerator Coil Cleaning Air Compressor and Vacuum" YouTube, Aug. 27, 2011 at www.youtube.com.

*Primary Examiner* — Mikhail Kornakov
*Assistant Examiner* — Ryan L. Coleman
(74) *Attorney, Agent, or Firm* — Richard P. Fennelly

(57) ABSTRACT

The invention relates to a method of cleaning the condenser coil subassembly of an air conditioning apparatus and a bag apparatus for achieving that result. The invention envisions placing a flexible bag construction over and generally around such subassembly, but not over or around the subassembly containing the other components of the air conditioner. This bag has an adjustable mouth portion that will fit over the condenser coil subassembly and also has respective hole means to allow the entry of compressed air and exit of vacuum air, respectively, to and from the enclosed area surrounding the condenser coil subassembly. When the bag is appropriately in place over the subassembly to be cleaned, compressed air is supplied to the enclosed area to loosen and remove debris from the coils while vacuum air is also supplied to remove the debris from the enclosed area to thereby resulting in a cleaning of the condenser coil subassembly without contaminating the area outside the bag.

1 Claim, 4 Drawing Sheets

(56) References Cited

U.S. PATENT DOCUMENTS

| | | | | |
|---|---|---|---|---|
| 4,865,401 | A | 9/1989 | Jacobson | |
| 6,863,116 | B1 | 3/2005 | Kane et al. | |
| 7,132,017 | B2 | 11/2006 | Laurence | |
| 2010/0236577 | A1* | 9/2010 | Yoo | 134/21 |
| 2011/0226286 | A1 | 9/2011 | Engleskjoenn | |

* cited by examiner

Typical Condenser Unit

Front View - Product In Use

Rear View of Bag

Rear View - Assembly

AIR CONDITIONER CONDENSER COIL CLEANING: METHOD, COMBINATION, APPARATUS

This application claims the benefit of U.S. Provisional Patent Application No. 61/626,404, filed Sep. 26, 2011 in the name of Jacob F. Steinmann.

A common way of cleaning the condenser coil subassembly of an air conditioning apparatus, as is well known to persons in the art, is carried out by directing a stream of compressed air against such a subassembly to loosen debris from the coils contained therein. This method, while effective, will generate unwanted airborne pollution in the area of the cleaning operation since the debris, once loosened, is not confined. The present invention is directed to curing this problem by providing an effective, simple, and economic containment bag-type apparatus.

The prior art contains the description of various dust containment structures to use in the air cleaning of a variety of structures, including air conditioner elements (see, for example, U.S. Pat. Nos. 1,620,390 and 6,295,696; JP 2004/322,032; and WO 2010/064924). Other structures of this general type have been designed for use in the water washing of such structures (see JP 4052499 of Feb. 20, 1992 and JP11325502 of Nov. 26, 1999 and CN 201237332).

Figure 1:
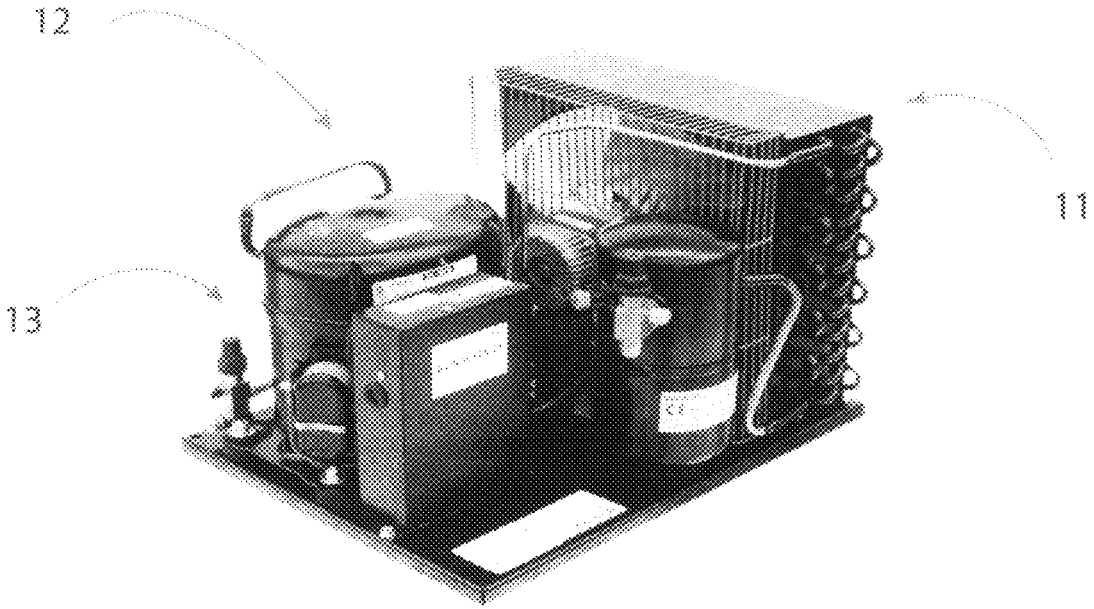
Figure 2:
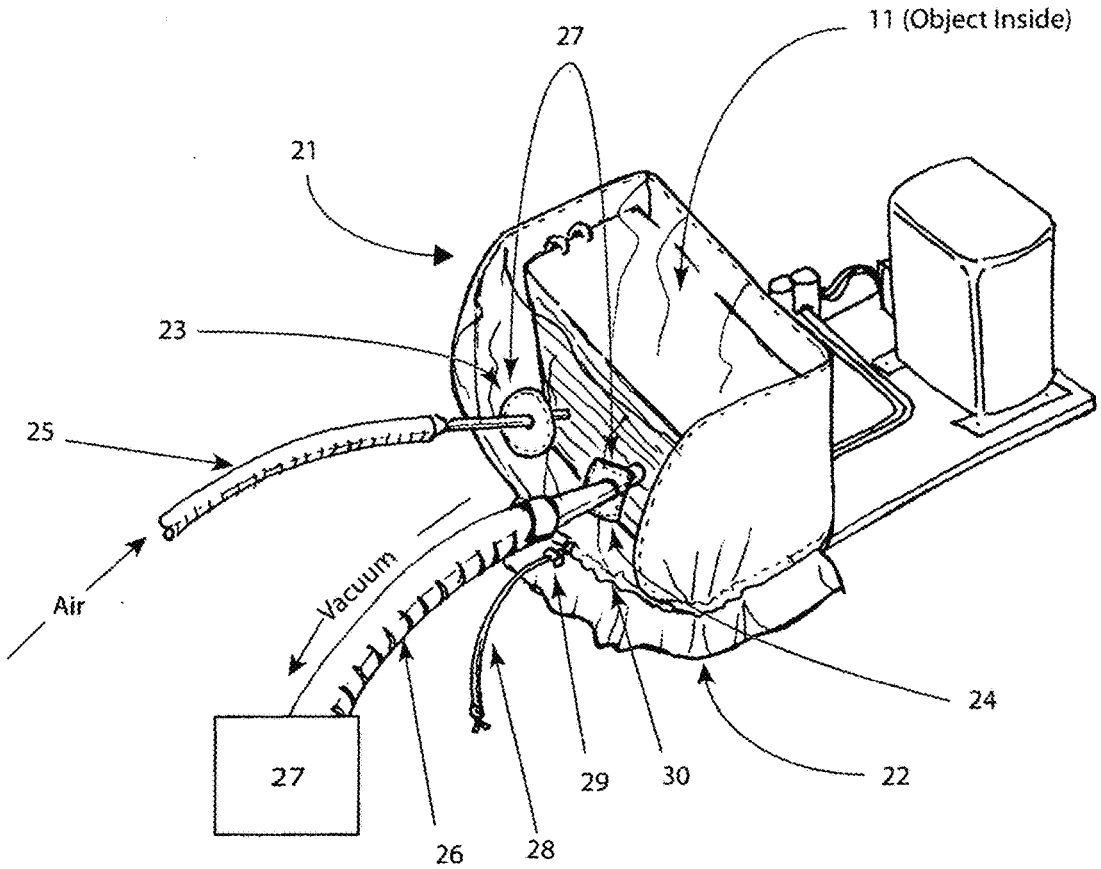
Figure 3:
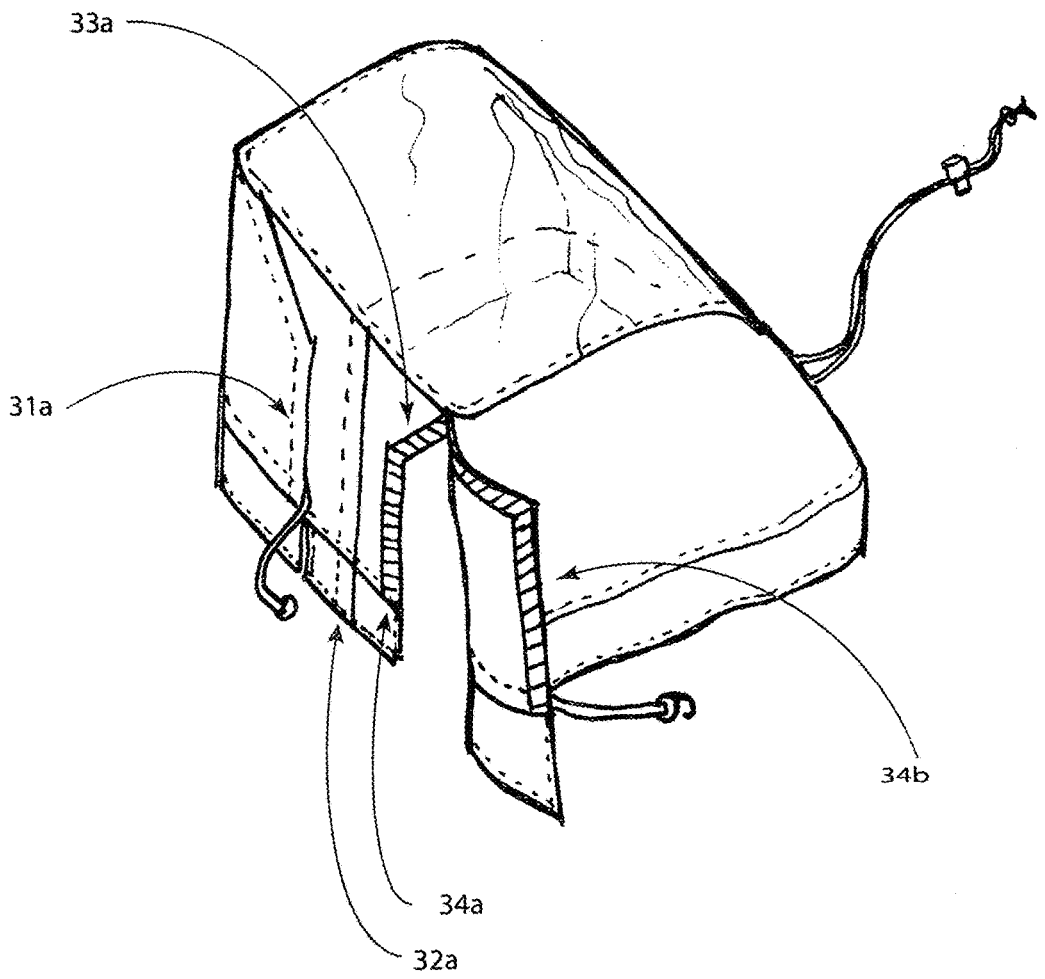
Figure 3A:
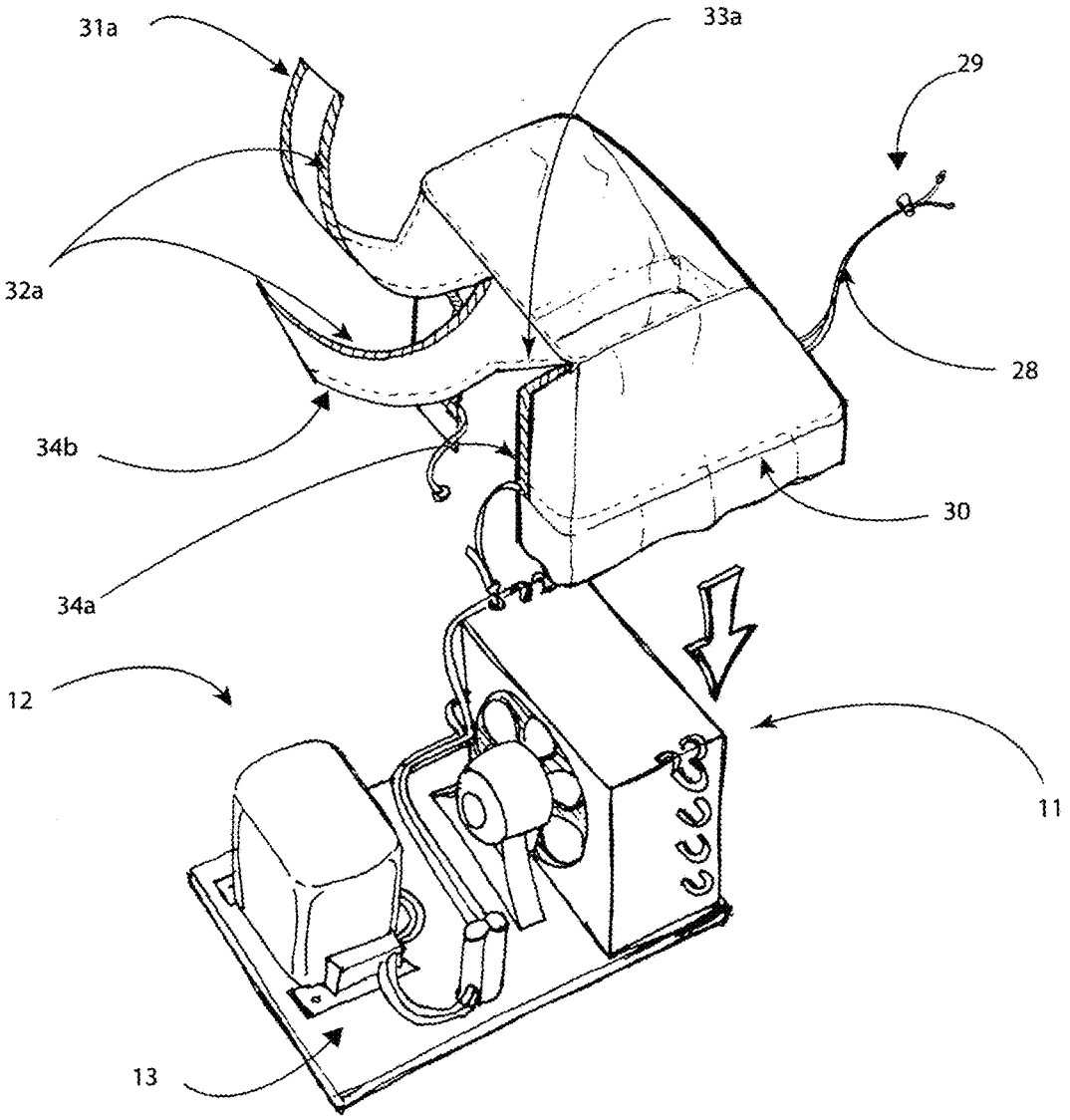

The enclosed Drawings illustrate the present invention wherein FIG. 1 is a perspective view of the type of air conditioner condenser unit intended to be cleaned by use of the present invention; FIG. 2 is a front perspective view showing the present invention in use to clean the apparatus shown in FIG. 1; FIG. 3 is a perspective view of the dust containment bag of this invention showing its rear surface; and FIG. 3*a* is a perspective view of the dust containment bag of this invention showing its rear surface and the apparatus of FIG. 1 which is intended to be cleaned with a downward facing arrow showing the direction of movement of the bag in its placement over apparatus to be cleaned to bring it into the configuration shown in FIG. 2.

The present invention, in one embodiment thereof, relates to a novel method for cleaning the condenser coil subassembly 11 (as shown in FIG. 1) of an air conditioning apparatus 12, preferably a refrigeration or freezer apparatus, such as those used in retail food stores to refrigerate or freeze a wide variety of food items. This method comprises the step of first placing a novel type of flexible dust containment bag 21 (as shown in FIGS. 2-3*a*) over, and generally around, such subassembly 11, but not over or around the subassembly 13 containing the other components of the air conditioner, which comprises the compressor with its associated electrical wiring, coolant conduits, etc. This bag 21 has a mouth portion 22 (see FIG. 2), which is preferably adjustable in size, that fits over the condenser coil subassembly 11. The surface of the bag also hole means 23 and 24 to allow the entry of compressed air and the exit of vacuum air, respectively, through the surface of the bag that covers and surrounds the condenser coil subassembly. More than one of such holes can be contained in the bag structure although the use of only two such holes may be most economical in constructing the containment bag. Therefore the use of the singular term "hole" in connection with each of these respective structures should be construed as respectively meaning "holes".

After the bag 21 has been placed over the subassembly 11 to substantially enclose such subassembly, compressed air is then supplied through a hose 25 and through one ("inlet") hole 23 into the interior of the enclosed area containing subassembly 11 to vigorously impact the condenser coils in that assembly and to thereby loosen and remove debris from the surface of the coils. Preferably, at the same time, vacuum air is supplied through another hose 26 through the other ("outlet") hole 24 to suction off and thereby remove the thus loosened and airborne, but confined, debris from within the enclosed area covered by the bag into a suitable receptacle 27 for disposal (i.e., into a vacuum bag contained within a vacuum cleaner that is located outside the bag). This operation results in the cleaning of the condenser coil subassembly of attached debris without the debris being blown into the atmosphere as is done by the conventional cleaning practice.

The present invention also includes as another embodiment the novel combination of: (a) a condenser coil subassembly of an air conditioning apparatus and (b) the previously described flexible bag construction that is designed to fit over and generally around such subassembly, but not over or around the subassembly containing the other components of the air conditioner.

A third embodiment of the present invention includes the previously described flexible bag construction itself, which is especially adapted to perform the method of cleaning that was mentioned hereinabove as the first embodiment of the present invention.

Some preferable construction embodiments for the bag itself include the following:

(a) at least a portion of the surface of bag 21, preferably that portion containing the holes for both supplying pressurized and vacuum air, is formed of clear plastic material to allow clear and direct viewing of the cleaning operation occurring inside the bag as it progresses;

(b) the inlet and outlet holes in the surface of bag 21 each have a diameter that is larger than the diameter of the hoses used to supply air and vacuum and are formed in that clear plastic material with each such hole being covered on its periphery with a more flexible material 27 that each, in turn, contain a central hole therein which is more substantially the diameter of the hoses used to supply air and vacuum to assist in holding the hose means supplying air to and from the bag but allowing movement of those holes;

(c) a suitable drawstring 28, mated with an appropriate fastener 29, which is threaded through a channel edging 30 formed in the bag 21 immediately adjacent the opening of the bag to allow that opening to be closed around the bottom of the coil subassembly 11 when the bag is placed over that subassembly (this restricts debris from exiting through the opening during the cleaning operation); and (d) one or more slit(s), designated by 31*a*, 31*b* and 31*c* in FIG. 3, extending down from the back top surface of the bag towards its bottom portion adjacent the opening 22. These slits have their respective facing surfaces, preferably lined with hook and loop fastener closure means 34*a* and 34*b* (e.g., VELCRO brand) for that type of closure) to facilitate placement of the bag over the desired subassembly and associated conduit piping leading to that assembly.

(e) if desired, one or more of the rear panels of the bag bounding slits 31*a* through 31*c* can have their bottom peripheries extended to form an integral skirt to enhance the sealing action of the bag at the border portion between subassemblies 11 and 13 of the air conditioner apparatus.

I claim:

1. A method of cleaning the condenser coil subassembly of an air conditioning apparatus which comprises: placing a flexible bag construction over and generally around the condenser coil subassembly such that the bag surrounds an area enclosed by the bag, but not over and around a subassembly containing other components of the air conditioner, said bag having an adjustable mouth portion that is fitted over the condenser coil subassembly, said mouth portion comprising a drawstring that allows the mouth portion to be closed, said bag comprising respective hole means in a first surface of the bag to allow the entry of compressed air and exit of vacuum air, respectively, to and from the area enclosed by the bag, said first surface of the bag having a portion that is clear to allow for viewing of the cleaning operation inside the bag, wherein a second surface of the bag comprises a plurality of closable slits that extend downwardly on the surface of the bag to facilitate placement of the bag over the condenser coil subassembly and associated conduit piping leading to the assembly, and wherein the slits are configured to be fastened to one another; and supplying compressed air to said enclosed area to loosen and remove debris from the coils and applying vacuum to remove loosened debris from said enclosed area thereby resulting in a cleaning of said condenser coil subassembly.

* * * * *